US005444812A

United States Patent [19]

Thibodeau

[11] Patent Number: 5,444,812

[45] Date of Patent: Aug. 22, 1995

[54] AUTOMATIC SPEED SERVO-CONTROL APPARATUS FOR ELECTRICALLY POWERED WALKING-RUNNING EXERCISE MACHINE

[76] Inventor: Émile Thibodeau, 4560, promenade Paton, unité 317, Chomedey, Laval (Québec), Canada, H7W 4W2

[21] Appl. No.: 246,138

[22] Filed: May 19, 1994

[51] Int. Cl.[6] ..... H02P 7/288

[52] U.S. Cl. ..... 388/840; 388/838; 482/6

[58] Field of Search ..... 482/1-2, 482/3, 4, 5, 6, 7, 8-9, 54, 66, 900, 908; 388/825-840, 903, 935

[56] References Cited

U.S. PATENT DOCUMENTS

| | | | |
|---|---|---|---|
| 4,635,927 | 1/1987 | Shu . | |
| 5,209,710 | 5/1993 | Shimizu et al. | 482/54 |
| 5,314,391 | 5/1994 | Potash et al. | 482/7 |
| 5,318,491 | 6/1994 | Houston | 482/54 |
| 5,328,422 | 7/1994 | Nichols | 482/52 |

*Primary Examiner*—David S. Martin
*Attorney, Agent, or Firm*—ROBIC

[57] ABSTRACT

A speed servo-control apparatus is provided for use in combination with a walking-running exercise machine including a moving belt on which a user may walk or run and a direct current drive input for controlling the speed of the moving belt. The apparatus has a frame bracket and a control unit rotatably mounted to the frame bracket, and is provided with an assembly for mounting the frame bracket at a predetermined position with respect to the machine. The apparatus is also provided with a cord assembly having two opposite extremities, one of the extremities being operatively connected to the control unit and the other of the extremities being attachable to the user of the apparatus so as to rotate the control unit in a given direction when the cord assembly is pulled forward. The apparatus is further provided with a recoil mechanism which is operatively connected to the control unit for rotating the control unit in a direction opposite to the given direction as soon as the cord assembly is released, and with an electrical generator which is operatively connected to the control unit and provided with at least two wires connectable to the direct current drive input for producing electrical signals which are proportional to the rotation of the control unit in the given direction. When the apparatus is used, after the frame bracket has been mounted at the predetermined position and the at least two wires electrically connected to the at least two wire direct current drive input, the position of the user of the machine, on the moving belt will increase or decrease the speed thereof.

6 Claims, 2 Drawing Sheets

AUTOMATIC SPEED SERVO-CONTROL APPARATUS FOR ELECTRICALLY POWERED WALKING-RUNNING EXERCISE MACHINE

BACKGROUND OF THE INVENTION a) Field of the Invention

The present invention relates to an automatic speed servo-control apparatus for an electrically powered walking-running exercise machine, like those known in the trade as "thread mill".

b) Brief Description of the Prior Art

As it is known any user of a conventional walking-running exercise machine must follow special procedures established by the machine's manufacturer in order to utilize this appliance with minimum risks of injuries. Mainly, these injuries may occur when the user falls while stepping in or out of the moving belt of the walking-running exercise machine.

To prevent such injuries, some walking-running exercise machines are provided with emergency cords installed on consoles in front of the machines. Nevertheless, the possibility of fall increases when the user pulls this emergency cord, because the cord produces a sudden stop instead of smooth deceleration.

Most of the conventional walking-running exercise machines are using rotary potentiometers installed on the consoles in front of the machines for varying the speed of their moving belts. This speed is adjusted as a function of the voltage generated from the rotary potentiometer and applied to the DC drive (Direct Current Drive) inputs of the walking-running exercise machine.

OBJECTS AND SUMMARY OF THE INVENTION

The object of the present invention is to provide an automatic speed servo-control apparatus for an electrically powered walking-running exercise machine, which has the necessary means by which the speed of the moving belt of the machine can be changed by the position of the user on the belt.

In accordance with the present invention, the above object is achieved with a speed servo-control apparatus for use in combination with a walking-running exercise machine including a moving belt on which a user may walk or run, and a two or three wire direct current drive input for controlling the speed of the moving belt.

The apparatus comprises a frame bracket and a control unit rotatably mounted to the frame bracket.

Means are provided for mounting the frame bracket at a predetermined position with respect to the machine. Such means preferably comprise means for attaching the frame bracket to a hinged arm connected to a railing frame located at an upper rear corner thereof, the arm allowing free access in and out of the railing frame.

The apparatus also comprises cord means having two opposite extremities, one of the extremities being operatively connected to the control unit and the other of the extremities being attachable to the user of the apparatus so as to rotate the control unit in a given direction when the cord means is pulled forward.

Moving means are provided and operatively connected to the control unit for rotating the control unit in a direction opposite to the given direction as soon as the cord means is released.

The apparatus further comprises generator means which are operatively connected to the control unit and provided with at least two wires connectable to the at least two wire direct current drive input, for producing electrical signals which are proportional to a rotation of the control unit in the given direction.

In operation, after the frame bracket has been mounted at said predetermined position relative to the machine and the at least two wires of the generator means have been electrically connected to the at least two wire direct current drive input, the position of the user of the machine, on the moving belt increases or decreases the speed thereof.

BRIEF DESCRIPTION OF THE DRAWINGS

In order to impart full understanding of the manner in which this object of the invention is achieved, a non-restrictive description of a preferred embodiment thereof will be given hereinafter with reference to the accompanying drawings, wherein.

DESCRIPTION OF A PREFERRED EMBODIMENT

Figure 1:
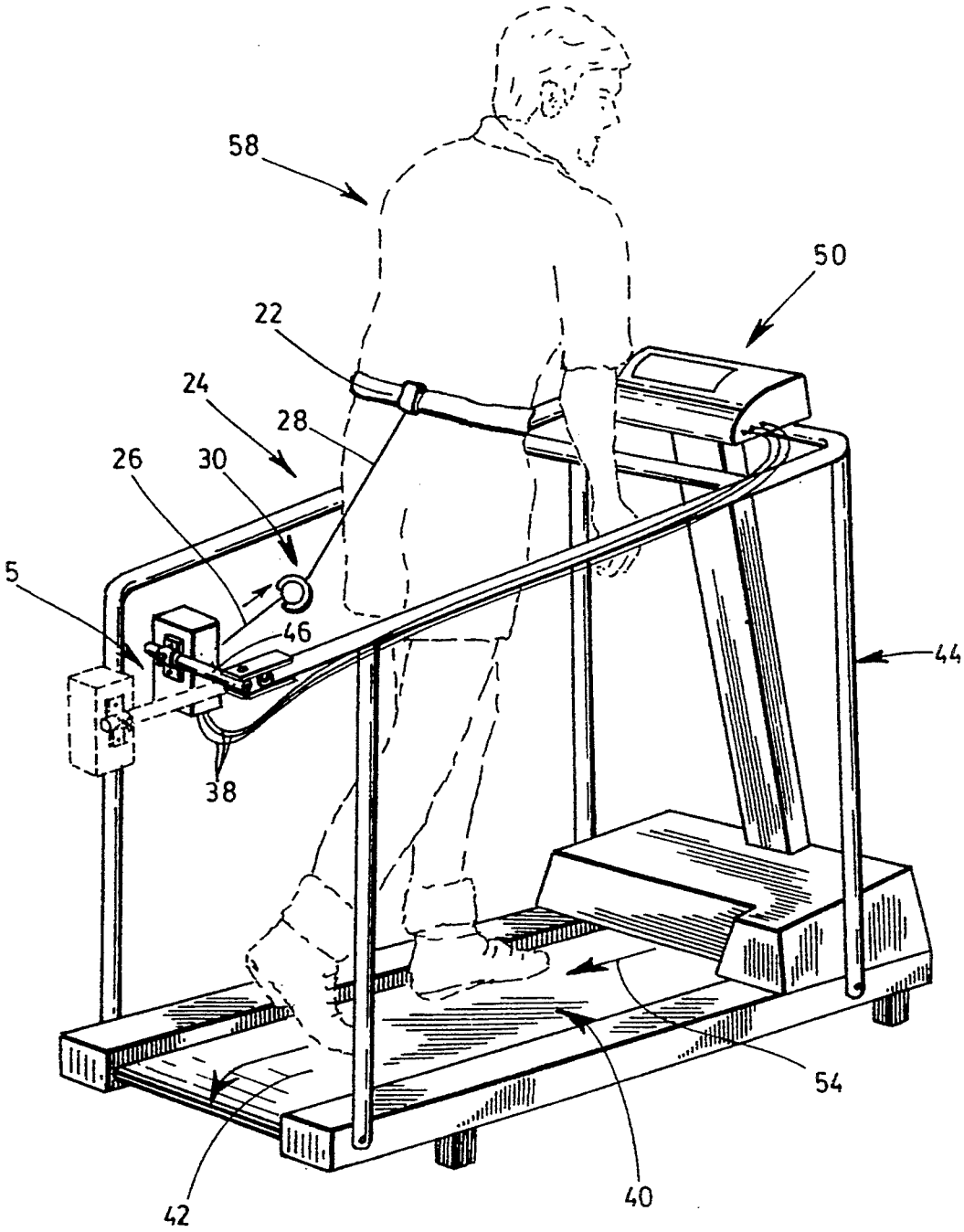
FIG. 1 is a perspective view of an automatic speed servo-control apparatus according to the invention attached to the railing frame of the moving belt of a walking-running exercise machine.
Figure 2:
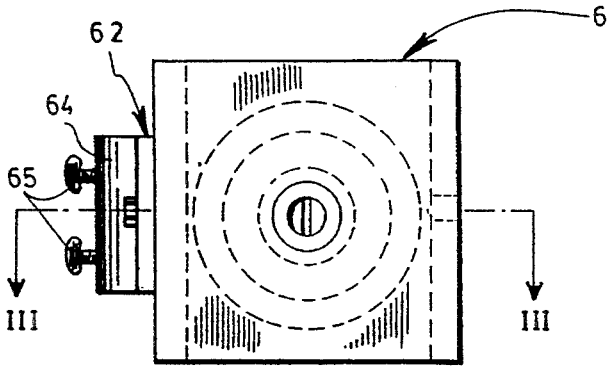
FIG. 2 is a top view of the automatic speed servo-control apparatus according to the present invention shown in FIG. 1.

As shown in FIG. 1, the automatic speed servo-control apparatus 5 according to the invention as shown in the accompanying drawings is intended to be used with a walking-running exercise machine 50 for controlling the speed of the moving belt 40 thereof.

Figure 3:
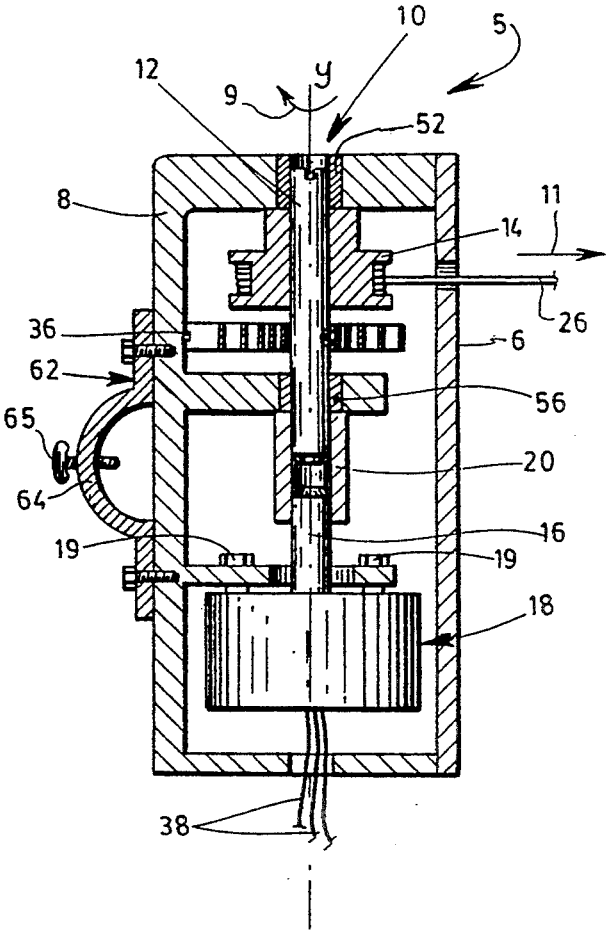
FIG. 3 is a cross sectional view of the speed servo-control apparatus along the line III—III of FIG. 2.

As better shown in FIG. 3 the apparatus 5 comprises a frame bracket 8 which defines a housing assembly that can be closed by a cover 6. It also comprises a control unit 10. The control unit 10 includes a rotary shaft 12 rotatably mounted to the frame bracket 8 by means of bearings, numbered 52 and 56, a drum 14 coaxially mounted onto the shaft 12, and an actuating shaft 16 of a rotary potentiometer 18 connected to the rotary shaft 12 via a cylindrical coupling member 20. The potentiometer 18 is secured to the frame bracket 8 by means of bolts 19 and includes three wires 38 for connection to the DC drive (Direct Current Drive) input of the walking-running exercise machine 50.

Figure 4:
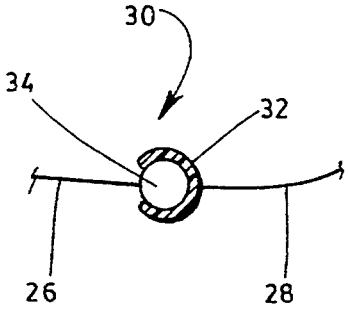
FIG. 4 is a schematic view of an automatic disconnecting device for use in the cord assembly of the speed servo-control apparatus shown in the previous Figures.

Referring back to FIG. 1, the apparatus 5 also comprises a cord assembly 24 including a belt 22 which is tied around the waist of the user 58. The cord assembly 24 also includes two strings, respectively 26 and 28. The string 28 is connected to the belt 22 and the string 26 is partially wound around the drum 14 and attached with one extremity thereto. The two strings 26 and 28 are interconnected by an automatic disconnecting device 30, shown schematically in FIG. 4. This automatic disconnecting device 30 is formed of two separate parts, 32 and 34 that can be snapped to each other. The device 30 serves for automatically disconnecting the strings 26 and 28 when a tension exceeding a predetermined maximum tension value is applied thereto.

When the strings 26 and 28 are pulled forwards, as shown with an arrow 11 in FIG. 3 and the tension applied thereto is lower than the predetermined maximum tension value, the control unit 10 rotates in a first direction shown with an arrow 9 with respect to a "y" axis.

However, as can be apparent to those skilled in the art, any other suitable device other than the above described strings can be used for rotating the control unit 10 in the first direction. For example, the cord assembly 24 could include a lever arm (not shown) having one extremity connected to the control unit 10 and extending therefrom in a perpendicular direction with respect to the "x" axis and at an angle with respect to the direction of pulling. The lever arm could have another extremity connected to a string connectable to the user of the machine in that way, the control unit 10 could be rotated between a first and a second position when the string 28 is pulled forwards.

The apparatus 5 further comprises moving means in the form of a spiral recoil spring 36 which is connected at one end to the shaft 12 and at the other end to the frame bracket 8. This recoil spring 36 serves for rotating the shaft 12 and the control unit 10 in opposite direction to the one shown with the arrow 9 as soon as the two strings 26 and 28 are released, so as to rotate the same and rewind at least part of the string 26 on the drum 14. Of course, if a lever arm and a string are used for rotating the control unit 10, the recoil spring 36 will serve for bringing back the lever arm to the first position as soon as the string is released.

It is worth mentioning that other devices than the above mentioned recoil spring 36 could be used for rotating the control unit 10 in a direction opposite to the one shown with the arrow 9 as soon as the strings 26 and 28 are released. For example, one could use a resilient string having one end connected to the drum and another end to the frame bracket, or a rewinding device connected to the string 26 and to the control unit 10, so as to rotate the latter as soon as the strings 26 and 28 are released.

Preferably, the automatic speed servo-control apparatus 5 is provided with a mounting plate 62 having a U-shaped middle portion 64 and two wing nuts 65 for attachment to the arm 46 hingedly mounted to the railing frame 44, secured to the exercise machine 50 on both sides of the moving belt. The arm 46 is preferably connected to an upper rear corner of the railing frame 44 at a predetermined distance with respect to the front of the exercise machine 50, and is devised to swing out at an angle of approximately 90° from its operative position (as shown in dotted lines) to allow free access in and out of the exercise machine 50. The apparatus 5 is slidably mounted onto the arm 46 by means of the U-shaped portion 64 and, by adjusting the aforesaid wing nuts 65, can be firmly secured thereto.

Once again, other devices or assemblies could be used for mounting the apparatus 5 at a predetermined distance with respect to the exercise machine 50. For example, pads made from fibrous hooks-and-loops type of material of the VELCRO type could be used for securing the apparatus 5 to a wall or any other object. When pads are used, one pad could be attached to the housing and the other pad to the wall or the other object. Another way of mounting the apparatus 5 at the predetermined position with respect to the exercise machine 50 may consist of hooks operatively connected to the housing 8 of the apparatus 5, and serving for securing the latter to the aforesaid hinged arm 46 or to another object.

In operation, when a user steps on the belt 40 at a rear end 42 thereof and walks forward with the belt 22 fastened around his or her waist, the string 26 partially wound around the drum 14 is pulled and turns the drum 14 and the actuating shaft 16 of the potentiometer 18. Then, the rotary potentiometer 18 produces electrical signals which are proportional to the position of its actuating shaft 16, and consequently to the position of the user 58. This change in position of the actuating shaft 16 increases or decreases the voltage sent to the input of the electronic DC drive of the exercise machine 50, which in turn increases or decreases the speed of the belt 40 thereof. As can be apparent to those skilled in the art, any other kind of electrical generator could be used for producing signals which are proportional to the rotation of the control unit 10.

When the user steps on the belt 40 at the rear end thereof 42 and remains at that position, no movement of the belt 40 occurs. As soon as the user 58 moves forward to a predetermined position (in relation to a reference point on the exercise machine 50), the belt starts to move at its minimum speed. As soon as the user walks faster, his body moves towards the front of the machine 50, thereby changing his or her position in relation to the reference point thereon. This change of position provides a change on the speed control and maintains a constant speed of the belt 40 as the user maintains his or her position by walking at a constant speed synchronized with the speed of the belt as per the following equation:

$$Wv - Vb = );$$

where Vw is equal to the walking speed of the user 58 and Vb is equal to the speed of the moving belt 40.

If the user wishes to increase or decrease his or her walking pace, the position of the user produced by an acceleration or deceleration of his or her body, repositions the speed control accordingly. As soon as the user stops walking the opposite motion of the belt retracts the user to the zero position, at the rear end 42 of the machine, and the moving belt 40 stops slowly.

It is worth mentioning, that the existing conventional control potentiometer of the walking-running exercise machine can be isolated by a selector switch (not shown). This selector switch can be used for selecting use or not of the speed servo-control apparatus.

As can be appreciated, there are various advantages in using the speed servo-control apparatus according to the invention as described hereinbefore. The main advantage is that when the user walks or runs on the moving belt of a walking-running exercise machine, the risks of falling due to fatigue for instance, are considerably reduced by effectively controlling the speed of this moving belt. Also, by effectively controlling the speed of the moving belt, the user can have a "more controlled" and thus better workout.

Although the present invention has been explained hereinabove by way of a preferred embodiment thereof, it should be pointed out that any modification to this preferred embodiment within the scope of the appended claims is not deemed to alter or change the nature and scope of the present invention.

I claim:

1. A speed servo-control apparatus for use in combination with a walking-running exercise machine including a moving belt on which a user may walk or run and an at least two wire direct current drive input for controlling the speed of said moving belt, said apparatus comprising:

a frame bracket;

a control unit rotatably mounted to said frame bracket;

mounting means for mounting said frame bracket at a predetermined position with respect to said machine;

cord means having two opposite extremities, one of said extremities being operatively connected to said control unit, the other one of said extremities being attachable to the user of the apparatus so as to rotate said control unit in a given direction when said cord means is pulled forward by said user;

moving means operatively connected to said control unit for rotating the control unit in a direction opposite to said given direction as soon as said cord means are released; and generator means operatively connected to said control unit and provided with at least two wires connectable to said at least two wire direct current drive input, said generator means producing electrical signals which are proportional to a rotation of said control unit in said given direction, whereby, after said frame bracket has been mounted at said predetermined position and said at least two wires of the generator means have been electrically connected to said at least two wire direct current drive input, the position of the user on said moving belt increases or decreases the speed thereof.

2. An apparatus according to claim 1, wherein said generator means comprise a rotary potentiometer with an actuating shaft.

3. An apparatus according to claim 2, wherein said control unit comprises:

a rotary shaft;

a drum coaxially mounted onto said rotary shaft; and a cylindrical coupling member connecting first rotary shaft to the actuating shaft of said rotary potentiometer.

4. An apparatus according to claim 3, wherein said moving means comprise a spiral coil spring, operatively connected to the rotary shaft of the control unit in such a manner as to rotate the same and rewind at least part of said cord means on said drum as soon as said cord means is released after it has been pulled by the user of the machine.

5. An apparatus according to claim 4, wherein said cord means comprise:

a first string and a second string;

an automatic disconnecting device interconnecting said first and second strings in such a manner as to automatically disconnect the strings when a tension exceeding a predetermined maximum tension value is applied to said first and second strings; and a belt connected to said second string.

6. An apparatus according to claim 4, wherein said mounting means comprise means for attaching said frame bracket to a hinged arm connected to a railing frame located at an upper rear corner thereof, said arm allowing free access in and out of said railing frame.

* * * * *